United States Patent [19]

Dubost et al.

[11] 4,323,399

[45] Apr. 6, 1982

[54] PROCESS FOR THE THERMAL TREATMENT OF ALUMINIUM - COPPER - MAGNESIUM - SILICON ALLOYS

[75] Inventors: Bruno Dubost; Jean Bouvaist, both of Grenoble, France

[73] Assignee: Cegedur Societe de Transformation de l'Aluminium Pechiney, Paris, France

[21] Appl. No.: 69,088

[22] Filed: Aug. 23, 1979

[30] Foreign Application Priority Data

Sep. 8, 1978 [FR] France ..... 78 26371

[51] Int. Cl.[3] ..... C22F 1/04

[52] U.S. Cl. ..... 148/12.7 A; 148/159

[58] Field of Search ..... 148/12.7 A, 159

[56] References Cited

U.S. PATENT DOCUMENTS 3,305,410 2/1967 Sublett et al. ..... 148/159

*Primary Examiner*—R. Dean

*Attorney, Agent, or Firm*—Dennison, Meserole, Pollack & Scheiner

[57] ABSTRACT

A process for the thermal treatment of wrought products made of an aluminum alloy of the 2000 series comprising by weight from 3.5 to 5% copper, from 0.2 to 1% magnesium, from 0.25 to 1.2% silicon, with a Si to Mg ratio greater than 0.8 comprising solution heat treatment, quenching treatment, ageing and tempering wherein the tempering treatment comprises at least two stages: (1) a main tempering treatment at a temperature higher than 225° C. and lower than 280° C. lasting between 6 seconds and 60 minutes and (2) a complementary tempering treatment at a temperature between 120° and 175° C. lasting between 4 and 192 hours. This process allows the compromise between the mechanical tensile characteristics and the resistance to intercrystalline and stress corrosion to be improved.

20 Claims, 2 Drawing Figures

PROCESS FOR THE THERMAL TREATMENT OF ALUMINIUM - COPPER - MAGNESIUM - SILICON ALLOYS

The present invention relates to a process for the thermal treatment of wrought products made of aluminum alloys of the 2000 series (aluminum-copper-magnesium-silicon) intended to improve their resistance to intercrystalline corrosion and to stress corrosion.

The process is applied to all wrought products made of aluminium-based alloys having, in particular, contents of 3.5 to 5% by weight of copper, from 0.2 to 1.0% by weight of magnesium and from 0.25 to 1.2% by weight of silicon, in such a way that the ratio by weight of Si to Mg is higher than 0.8. These alloys can also have contents which are less than or equal to 1% by weight of manganese, 0.5% by weight of chromium and 0.3% by weight of zirconium.

The aluminium alloy which is most characteristic of this range of compositions is the alloy known as 2014 according to the designations of the Aluminium Association. This alloy and its variations, 2X14 (2214 etc.), which differ from the 2014 by smaller iron contents are very widely used in the aeronautical industry.

The thermal treatment of these alloys is carried out at present by means of a solution heat treatment at a temperature which is generally below 510° C., quenching as quickly as possible, ageing for several days at ambient temperature (T4 state) and single tempering at a temperature which is generally between 150° and 190° C. for an isothermal residence time of between 4 and 48 hours (T6 state). This range of thermal treatments is the one adopted, in particular, for die stamped products. The known method of performing thermal treatment of rolled, forged or extruded products also includes cold working by plastic deformation of 1 to 5% of the crude quenched products prior to ageing and tempering, intended to relax the quenched products. This cold working can be effected by controlled traction or flattening of long products (T351 state after ageing or T651 state after isothermal tempering) and by compression of forged products (T352 or T652 states).

With the present T6 or T651 state, the products have very good mechanical tensile characteristics (tensile stress Rp and yield stress at 0.2% residual deformation Rp 0.2), but their resistance to intercrystalline corrosion and to stress corrosion in the short transverse direction is poor.

The resistance to intercrystalline corrosion is evaluated after immersion for 6 hours in NaCl—$H_2O_2$ reagent in accordance with French aeronautical standard AIR 9050 C.

The resistance to stress corrosion is evaluated in the short transverse direction after the alternate immersion emersion test in aeronautical reagent A3 in accordance with the AIR 9050 C standard. It is characterised by the non-breaking stress in 30 days of tests ($\sigma$ NR 30) which is often given as a percentage of the yield stress Rp 0.2 in the short transverse direction.

Under these conditions, the 2014 alloy has a non-breaking stress in the short transverse direction of less than 100 MPa in 30 days of tests in the T6 (or T651) state, and even in the absence of an applied stress, is very sensitive to intercrystalline corrosion after the NaCl—$H_2O_2$ test.

The applicants have found that it was possible to improve significantly the compromise between the mechanical characteristics and the corrosion resistance of the alloys forming the subject of the invention after treatment, without altering the compositions from the way in which they are defined industrially and under conditions which are economically satisfactory, in particular with regard to the duration of the thermal treatment.

The thermal treatment according to the invention involves solution heat treatment, quenching, possibly cold working by plastic deformation of 1 to 5% after quenching, intended to relax the quenched products (for example by flattening, controlled traction or compression), ageing at ambient temperature for an indeterminate period and final tempering comprising at least two stages:

1. Main tempering at a temperature higher than 225° C. and lower than 280° C. for a period of between 6 seconds and 1 hour, the temperature being the maximum temperature attained by the coldest part of the product to be treated and the duration of tempering being counted between the moment when the temperature defined in this way exceeds 225° C. in the rising direction and the amount when it attains 225° C. in the falling direction.

The higher the temperature attained, the shorter the residence time above 225° C.

2. Complementary tempering at a temperature between 120° and 175° C. for a period of between 4 hours and 8 days.

The main tempering treatment can optionally be preceded by preheating for a period of less than or equal to 24 hours at a temperature lower than or equal to 160° C.

The temperatures and durations of the main tempering treatment, as defined above, are preferably situated, in a graph having temperature and time coordinates, within a quadrangle having the following points as peaks:

(a) when the product has been cold worked after quenching and before tempering:

| | |
|---|---|
| A = (225° - 7 mn) | B = (225° - 40 mn) |
| D = (280° - 6 s) | C = (280° - 3 mn) |

(b) when the product has not been cold worked:

| | |
|---|---|
| E = (225° - 10 mn) | F = (225° - 60 mn) |
| H = (280° - 9 s) | G = (280° - 5 mn) |

For the main tempering, the speed at which the temperature rises and the speed at which the product to be treated is cooled, must be sufficiently fast. In particular, between 175° and 225° C., they must be higher than 1° C./mn on average.

After the main tempering treatment the product has to be cooled either to ambient temperature or to the complementary tempering temperature. It can thus be cold worked by a plastic deformation of 1 to 5% intended to relax it if this operation has not already been carried out between quenching and the main tempering treatment.

The temperatures and durations of the complementary tempering treatment are preferably situated, in a graph having temperature and time coordinates, within a quadrangle having the following peaks:

(a) if the product has been cold worked after quenching and before complementary tempering:

| | |
|---|---|
| I = (120° - 36 h) | J = (120° - 144 h) |
| L = (175° - 4 h) | K = (175° - 16 h) |

(b) if the product has not been cold worked before complementary tempering:

| | |
|---|---|
| M = (120° - 54 h) | N = (120° - 216 h) |
| P = (175° - 6 h) | O = (175° - 24 h) |

If cold working is carried out between main tempering and complementary tempering, the complementary tempering temperature will preferably be at least 70° C. lower than that of the main tempering treatment. In this case, cold working can be carried out at an intermediate temperature between the main tempering temperature and the ambient temperature.

The conditions of the thermal treatment according to the invention are illustrated in the attached drawings which show semi-logarithmic temperature time coordinates.

An advantage of the present invention is that the conditions of the main tempering treatment can be reproduced readily as they are obtained by merely controlling the development of the temperature in the coldest portion of a control article. In addition, the main tempering treatment need not include an isothermal stage at a temperature higher than 225° C. It can therefore be carried out on products of all thicknesses and by means of a very wide variety of methods which allow a sufficiently rapid rise in temperature, for example a ventilated furnace, passage furnace, high frequency furnace, bath of oil, salt or molten metal, or by the Joule effect, depending on the nature of the product to be treated.

Figure 1:
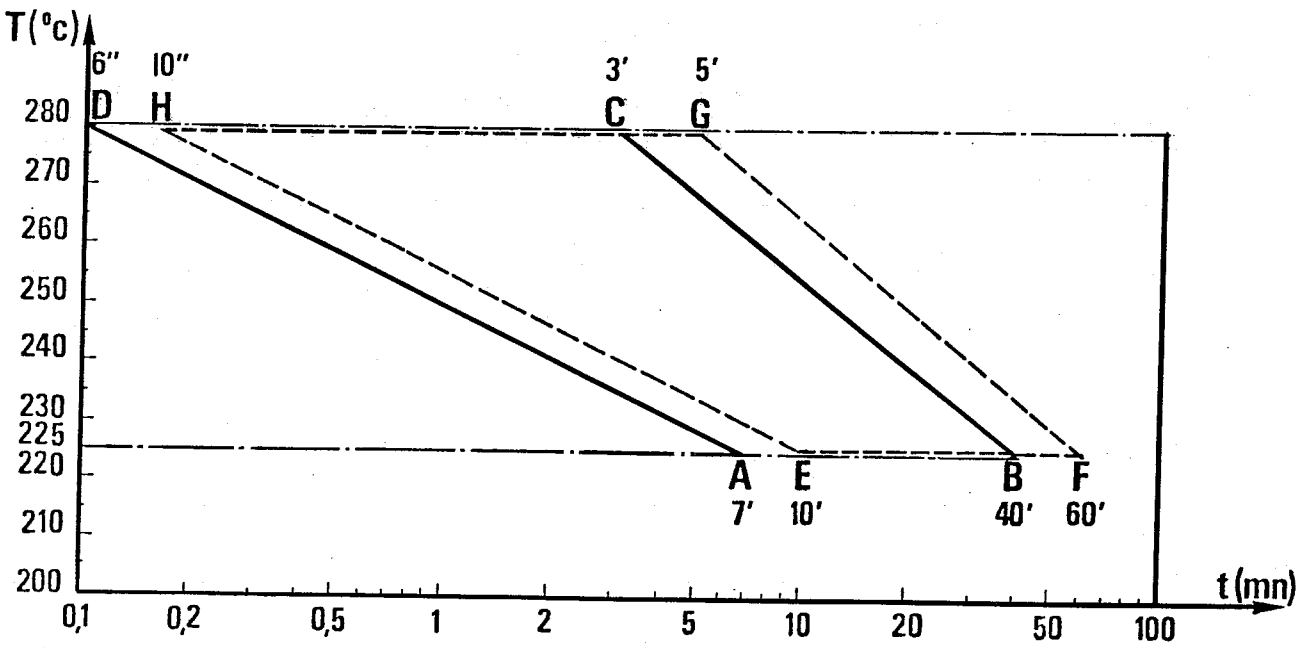
FIG. 1 shows the ABCD range (cold worked products) and EFGH range (products which have not been cold worked) of the main tempering treatment.

The knowledge of the temperature of the coldest part of the article at any moment, particularly when it exceeds 225° C., allows the main tempering treatment to be interrupted so that the residence time of the article at a temperature higher than 225° C. is within the range of durations corresponding to the maximum temperature attained, this range being defined by FIG. 1.

The products treated according to the present invention have:

(i) mechanical tensile characteristics (tensile stress Rm and yield stress at 0.2% residual elongation Rp 0.2) which are at least 90% of those obtained in the present T6, T651 or T652 state depending on the nature of the products, without a reduction in ductility (ii) resistance to intergranular corrosion evaluated by the NaCl—$H_2O_2$ test (AIR 9050 C standard) which is very much higher than that of the T6 (T651–T652) states, (iii) resistance to stress corrosion which is much higher than that of the products treated by the present T6 (or T651, T652) state since their non-breaking stress in the short transverse direction is higher than 70% of the yield stress Rp 0.2 in 30 days of alternate immersion-emersion tests in A3 reagent in accordance with the AIR 9050 C standard.

The process according to the invention is applied to the thermal treatment of rolled, forged, die stamped, extruded or other products, whatever the homogenization treatment or solution heat treatment carried out prior to quenching and whatever the method of relaxing by cold working after quenching. However, it is particularly advantageous for the alloy to have been homogenized at a temperature between the initial melting temperature of metastable eutectics and the temperature of the solidus of equilibrium of the alloy, as described in French Pat. No. 2,278,785, before it is worked.

The combination of this homogenization treatment and a tempering treatment according to the invention gives the alloy a number of improved characteristics, without the need to modify its composition, since the yield stress Rp 0.2 is at least 95% of that obtained on an alloy of the same composition having been cold worked in the same way and tempered by the T6 or T651 treatment with an elongation (A %) which is greater than that of the present T6 state.

In the particular case of the 2014 or 2214 alloy, the applicants have found that the modification of the alloy by increasing the Cu and/or Mg and/or Si content to their limit of solubility in the aluminum at the homogenization temperature (according to the certificate of addition No. 2,293,497 to French Pat. No. 2,278,785) combined with homogenization carried out at a temperature between the initial melting temperature of the metastable eutectics and the temperature of the solidus of equilibrium of the alloy (as described in French Pat. No. 2,278,785) and a tempering treatment according to the invention, allows a compromise to be reached between the mechanical tensile characteristics and the resistance to stress corrosion which is quite exceptional for alloys of the 2000 series and is impossible to achieve by other methods in the present state of the art. In fact, the products made of 2014 alloy having a modified composition have, after special homogenization and tempering according to the invention, mechanical tensile characteristics (Rm and Rp 0.2) which are better than those of the conventional 2014 alloy treated by the T6 (or T651 or T652) state, without reducing the elongation or the tenacity and in addition a much better resistance to corrosion. The non-breaking stress is higher than 75% of the yield stress Rp 0.2, and the alloy treated according to the invention is not susceptible to intercrystalline corrosion in accordance with the AIR 9050 C standard.

These advantages are illustrated by the following embodiments which are given for guidance and are not limiting.

EXAMPLE 1

Some 60 mm thick sheets made of 2214 alloy, having the conventional composition (Cu=4.4-MG=0.4-Mn=0.6-Si=0.8) were subjected, after conventional homogenization, to a conventional solution heat treatment at 505° C. followed by cold water quenching, controlled traction of 2.2%, ageing for a period of two months at ambient temperature and conventional T651 tempering treatments or tempering treatments according to the invention, controlled by a thermocouple placed in the core.

The main tempering treatment (RP) was carried out in a nitrite-nitrate salt bath.

Table I below indicates the residence time of the article at a temperature higher than 225° C. and the maximum temperature reached by the product. The products were cooled in water after the main tempering treatment, and the complementary tempering treatment (RC) was carried out in a ventilated fixed furnace. Table I gives the mechanical tensile characteristics in the long transverse direction and short transverse direction, the non-breaking stress $\sigma$ NR 30 under stress corrosion in the short transverse direction (100, 200 and 300 MPa stresses imposed) in accordance with the AIR 9050 C standard, and the resistance to intercrystalline corrosion according to the AIR 9050 C standard.

All the characteristics were measured halfway through the thickness of the sheets.

This Example shows the very significant improvement in the resistance to stress corrosion and to intercrystalline corrosion of the products which is obtained at the expense of a reduction in the mechanical tensile characteristics which is less than 10% relative to the T651 state.

EXAMPLE 2

Some 2.5 mm thick sample sheets made of 2014 alloy were subjected to the following thermal treatment:

(i) solution heat treatment at 505° C. for 4 hours (ii) water quenching at 20° C. followed by controlled traction of 2%

(iii) ageing for 5 days (iv) convention T6 tempering in a ventilated fixed furnace or main tempering according to the invention in a salt bath furnace (instantaneous rise in temperature)

(v) air cooling (vi) complementary tempering according to the invention in a ventilated fixed furnace.

Table II below shows the Vickers hardness (under a load of 3 kg) and the susceptibility to intercrystalline corrosion ($NaCl—H_2O_2$) at the surface of sheets.

TABLE II

| STATE | THERMAL TREATMENT | | HV hardness (kg/mm²) | intercrystalline corrosion* |
|---|---|---|---|---|
| Present T651 | | 175° C.-8h | 158 | S |
| super-tempering | | 175° C.-48h | 148 | S |
| — | R.P(230° C.-3mn) + R.C | (175° C-18h) | 170 | VS |
| According to the invention | R.P(230° C.-5mn) + R.C | (140° C.-36h) | 169 | W |
| According to the invention | R.P(230° C.-20mn) + R.C | (120° C.-96h) | 150 | no |
| — | R.P(230° C.-35mn) + R.C | (150° C.-24h) | 144 | M |
| — | R.P(230° C.-10mn) + R.C | (175° C.-2h) | 155 | S |
| According to the invention | R.P(250° C.-5mn) + R.C | (160° C.-16h) | 149 | no |
| — | R.P(260° C.-8mn) + R.C | (150° C.-48h) | 146 | M |
| According to the invention | R.P(275° C.-30 s) + R.C | (150° C-24h) | 150 | no |
| According to the invention | R.P(275° C.-2mn) + R.C | (175° C.-8h) | 143 | no |
| — | R.P(275° C.-4mn) + R.C | (140° C.-36h) | 131 | m |

*VS = Very Strong, S = Strong, M = Medium, W = Weak

This Example shows that only the main tempering treatment and the complementary tempering treatment carried out in the ranges of durations and temperature (higher than 225° C.) claimed by the invention allow the

TABLE 1

| | | MECHANICAL CHARACTERISTICS | | | | | | RESISTANCE TO | |
|---|---|---|---|---|---|---|---|---|---|
| | | Long transverse direction | | | Short transverse direction | | | Stress corrosion | intercrystalline corrosion |
| STATE | THERMAL TREATMENT | Rp 0,2 MPa | Rm MPa | A % | Rp 0,2 MPa | Rm MPa | A % | $\sigma$ NR 30 MPa | P = pitting I = intercrystal |
| T651 | 154° C.-22h | 422 | 470 | 6,2 | 404 | 460 | 5,0 | <100 | P + I |
| acc.to invent. | R.P(235° C.-9mn) + R.C(150° C-24h) | 385 | 445 | 6,2 | 385 | 440 | 5,0 | >300 | P |
| acc.to invent. | R.P(250° C.-6mn) + R.C(150° C.-24h)/ 382 | 441 | 7,5 | 377 | 433 | 4,1 | >300 | P | |
| acc.to invent. | R.P(255° C.-8mn) + R.C(150° C.-24h) | 362 | 427 | 7,5 | 362 | 423 | 4,5 | >300 | P |

2014 alloy to be desensitized from intercrystalline corrosion with a slight reduction in the hardness.

EXAMPLE 3

Some 60 mm thick sheets of 2214 alloy having its composition modified in accordance with the certificate of addition no. 2,293,497 to French Pat. No. 2,278,785 (Cu=4.5-Mg=0.6-Si=0.8-Mn=0.6-Fe=0.2) were subjected to:

(i) homogenisation as described in French Pat. No. 2,278,785 before rolling, (ii) cold water quenching followed by controlled traction by 2.5%, ageing for one month at ambient temperature.

(iii) conventional T751 tempering in a ventilated fixed furnace or tempering according to the invention comprising a main tempering treatment in a furnace containing a nitrite-nitrate salt bath followed by water cooling and complementary tempering in a ventilated fixed furnace. The main tempering was preceded by heating to 154° C. (rise for 8 hours—maintained for 4 hours) for the sheets labelled A and C.

Table III below gives the mechanical tensile characteristics and the non-breaking stress $\sigma$ NR 30 in 30 days of stress corrosion testing in A3 reagent (100, 200, 300 MPa stresses imposed) in the short transverse direction.

TABLE III

| ITEM | STATE | THERMAL TREATMENT Heating | THERMAL TREATMENT Tempering | MECHANICAL CHARACTERISTICS Short transverse direction RpO, 2 Mpa | Rm MPa | A % | $\sigma$NR 30 MPa |
|---|---|---|---|---|---|---|---|
| 0 | present T651 | No | 154° C.-22h | 463 | 523 | 4,1 | <100 |
| A | acc. to inven | 154° C.-4h | R.P(230° C.-4mn30s) + R.C(175° C.-8h) | 465 | 512 | 4,4 | >100 <200 |
| B | acc. to inven | No | R.P(230° C.-12mn + R.C(150° C.-24h) | 472 | 513 | 4,4 | >300 |
| C | acc. to inven | 154° C.-4h | R.P(230° C.-30mn) + R.C(175° C.-8h) | 441 | 492 | 5,0 | >300 |
| D | | No | R.P(250° C.-6mn) + R.C(160° C.-16h) | 441 | 490 | 5,0 | >300 |

This example shows that the combinations of the tempering treatment according to the invention with the above-mentioned modification in composition and the homogenization according to French Pat. No. 2,278,785, allows a compromise to be made between the mechanical tensile characteristics and the stress corrosion resistance, which are quite exceptional for this alloy.

EXAMPLE 4

Some forged blanks made of 2014 alloy measuring 90×210×500 mm were subjected to the following operations:

(i) solution heat treatment at 505° C. for 12 hours (ii) water quenching at 65° C.

(iii) ageing for 3 days (iv) conventional T6 tempering (20 hours at 160° C.) in a ventilated fixed furnace or tempering according to the invention in a bath of nitrite-nitrate salt for the main tempering treatment and in a ventilated fixed furnace for the complementary tempering treatment.

Table IV indicates the residence time for which the blanks are kept at a temperature above 225° C. and the maximum temperature reached by the blanks, measured by a thermocouple halfway through the thickness.

It shows (a) the mechanical tensile characteristics halfway through the thickness in the direction of the fibers (longitudinal direction) and perpendicularly to the fibers (short transverse direction).

(b) the non-breaking stress $\sigma$ NR 30 under stress corrosion halfway through the thickness in the short transverse direction in 30 days of alternate immersion-emersion tests (in accordance with standard AIR 9050 C).

The Table shows that the conditions of the main tempering treatment and the complementary tempering treatment according to the invention allow good resistance to stress corrosion to be achieved with mechanical stress characteristics (Rp 0.2 in particular) which are at least 90% of those of the present T6 state.

TABLE IV

| STATE | THERMAL TREATMENT | MECHANICAL CHARACTERISTICS Lengthwise direction Rp 0,2 Mpa | Rm MPa | A % | Short transverse direction Rp 0,2 MPa | Rm MPa | A % | Stress corrosion in the short transverse direction $\sigma$ NR 30 MPa |
|---|---|---|---|---|---|---|---|---|
| present T6 | 160° C.-20h | 417 | 482 | 9,0 | 413 | 465 | 4,8 | <100 |
| outside range | R.P(230° C.-5mn) + R.C(175° C.-16h) | 423 | 475 | 8,3 | 399 | 460 | 4,6 | <200 |
| accord. to invent. | R.P(230° C.-25mn) + R.C(160° C.-24h) | 402 | 470 | 9,5 | 385 | 457 | 5,0 | >280 |
| accord. to | R.P-245° C.-12mn) + R.C(175° C.-16h) | 387 | 466 | 9,8 | 374 | 448 | 5,4 | >280 |

TABLE IV-continued

| STATE | THERMAL TREATMENT | MECHANICAL CHARACTERISTICS Lengthwise direction Rp 0,2 Mpa | Rm MPa | A % | Short transverse direction Rp 0,2 MPa | Rm MPa | A % | Stress corrosion in the short transverse direction σ NR 30 MPa |
|---|---|---|---|---|---|---|---|---|
| invent. outside range | R.P(255° C.-22mn) + R.C(150° C.-12h) | 349 | 432 | 10,4 | 338 | 425 | 5,7 | >240 |

We claim:

1. A process for the thermal treatment of wrought products made of aluminum-base high silicon alloy of the 2000 series consisting essentially of by weight, from about 3.5 to 5% of copper, from about 0.2 to 1% magnesium, from about 0.5 to 1.2% silicon, a Si to Mg ratio>1.0 and from about 0 to 1% manganese, from about 0 to 0.5% chromium and from about 0 to 0.3% zirconium, said treatment consisting of the essential sequential steps of solution heat treatment, quenching, ageing at ambient temperature and tempering, wherein said tempering comprises at least two sequential stages:

(a) the first stage being a main tempering treatment at a temperature higher than about 225° C. and lower than about 280° C. for a period of between about 6 seconds and about 60 minutes; and (b) the second stage being a complementary tempering treatment at a temperature between about 120° C. and about 175° C. for a period of between about 4 and about 192 hours.

2. A process according to claim 1, wherein the main tempering treatment step is preceded by a heating treatment for a period which is less than or equal to about 24 hours at a temperature which is less than or equal to about 160° C.

3. A process according to claim 1 in which the products are cold worked by plastic deformation of from about 1 to about 5% after the quenching treatment step, wherein the point which is representative of the main tempering treatment step in a temperature/time graph is situated in a quadrangle ABCD, of FIG. 1 having as approximate coordinates:

| | |
|---|---|
| A = 225° - 7 mn | B = 225° - 40 mn |
| D = 280° - 6 s | C = 280° - 3 mn |

4. A process according to claim 1 in which the products are not cold worked after quenching, wherein the point which is representative of the main tempering treatment step in a temperature/time graph is situated in a quadrangle EFGH of FIG. 1, having as its approximate coordinates:

| | |
|---|---|
| E = 225° - 10 mn | F = 225° - 60 mn |
| H = 280° - 9 s | G = 280° - 5mn |

Figure 2:
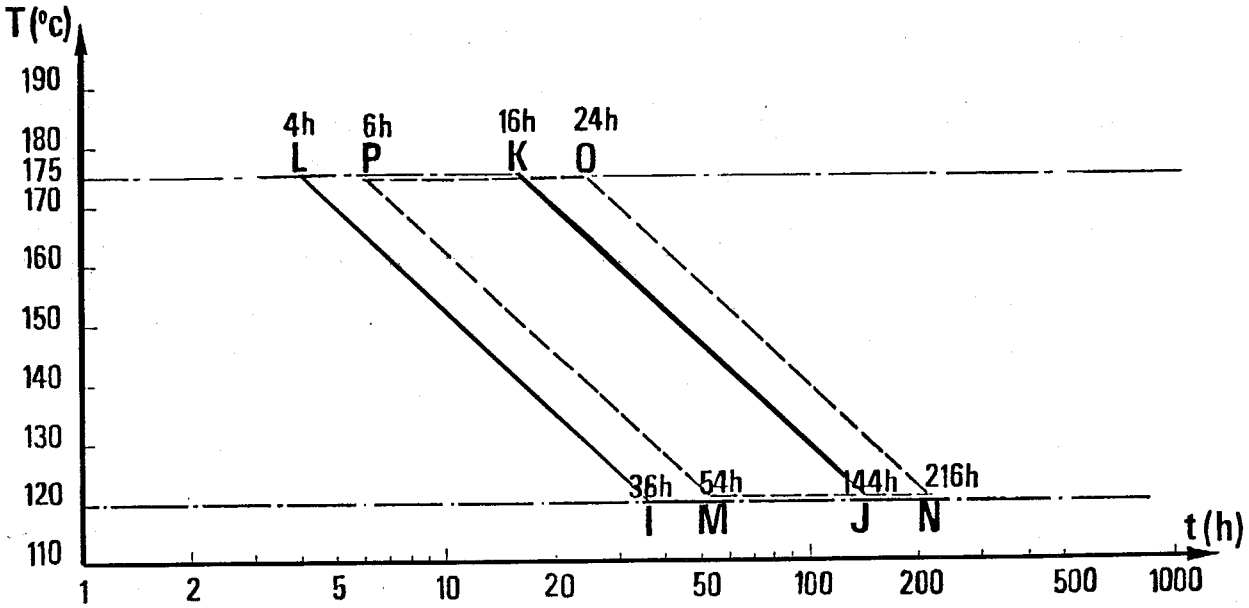
FIG. 2 shows the IJKL range (cold worked products) and MNOP range (products which have not been cold worked) of the complementary tempering treatment.

5. A process according to claim 1 in which the products are cold worked by plastic deformation of from about 1 to about 5% between the quenching and complementary tempering treatment steps wherein the point which is representative of the complementary tempering in a temperature/time graph is situated inside a quadrangle IJKL of FIG. 2, having as its approximate coordinates:

| | |
|---|---|
| I = 120° - 36 h | J = 120° - 144 h |
| L = 175° - 4 h | K = 175° 16 h |

6. A process according to claim 1 in which the products are not cold worked between the quenching and complementary tempering treatment steps wherein the point which is representative of the complementary tempering treatments in a temperature/time graph is situated inside a quadrangle MNOP of FIG. 2 having as its approximate coordinates:

| | |
|---|---|
| M = 120° - 54 h | N = 120° - 216 h |
| P = 175° - 6 h | O = 175° - 24 h |

7. A process according to claim 5, wherein the temperature of the complementary tempering treatment step is lower by at least about 70° C. than that of the main tempering treatment step.

8. A process according to claim 1 wherein the alloy is homogenized, before it is worked, at a temperature between the initial melting temperature of the metastable eutectics and the temperature of the solidus of equilibrium.

9. A process according to claim 2 in which the products are cold worked by plastic deformation of about 1 to about 5% after the quenching treatment step, wherein the point which is representative of the main tempering treatment step in a temperature/time graph is situated in a quadrangle ABCD of FIG. 1, having as approximate coordinates:

| | |
|---|---|
| A = 225° - 7 mn | B = 225° - 40 mn |
| D = 280° - 6 s | C = 280° 3 mn |

10. A process according to claim 2 in which the products are not cold worked after quenching, wherein the point which is representative of the main tempering treatment step in a temperature/time graph is situated in a quadrangle EFGH of FIG. 1, having as its approximate coordinates:

| | |
|---|---|
| E = 225° - 10 mn | F = 225° - 60 mn |
| H = 280° - 9 s | G = 280° - 5 mn |

11. A process according to claim 2 in which the products are cold worked by plastic deformation of from about 1 to about 5% between the quenching and complementary tempering treatment steps wherein the point which is representative of the complementary tempering in a temperature/time graph is situated inside a quadrangle IJKL of FIG. 2, having as its approximate coordinates:

| | |
|---|---|
| I = 120° - 36 h | J = 120° - 144 h |
| L = 175° - 4 h | K = 175° - 16 h |

12. A process according to claim 4 in which the products are cold worked by plastic deformation of from about 1 to about 5% between the quenching and complementary tempering treatment steps wherein the point which is representative of the complementary tempering in a temperature/time graph is situated inside a quadrangle IJKL of FIG. 2, having as its approximate coordinates:

| | |
|---|---|
| I = 120° - 36 h | J = 120° - 144 h |
| L = 175° - 4 h | K = 175° - 16 h |

13. A process according to claim 2 in which the products are not cold worked between the quenching and complementary tempering treatment steps wherein the point which is representative of the complementary tempering treatments in a temperature/time graph is situated inside a quadrangle MNOP of FIG. 2 having as its approximate coordinates:

| | |
|---|---|
| M = 120° - 54 h | N = 120° - 216 h |
| P = 175° - 6 h | O = 175° 24 h |

14. A process according to claim 4 in which the products are not cold worked between the quenching and complementary tempering treatment steps wherein the point which is representative of the complementary tempering treatments in a temperature/time graph is situated inside a quadrangle MNOP of FIG. 2 having as its approximate coordinates:

| | |
|---|---|
| M = 120° - 54 h | N = 120° - 216 h |
| P = 175° - 6 h | O = 175° - 24 h |

15. A process according to claim 2 wherein the alloy is homogenized, before it is worked, at a temperature between the initial melting temperature of the metastable eutectics and the temperature of the solidus of equilibrium.

16. A process according to claim 3 wherein the alloy is homogenized, before it is worked, at a temperature between the initial melting temperature of the metastable eutectics and the temperature of the solidus of equilibrium.

17. A process according to claim 4 wherein the alloy is homogenized, before it is worked, at a temperature between the initial melting temperature of the metastable eutectics and the temperature of the solidus of equilibrium.

18. A process according to claim 5 wherein the alloy is homogenized, before it is worked, at a temperature between the initial melting temperature of the metastable eutectics and the temperature of the solidus of equilibrium.

19. A process according to claim 6 wherein the alloy is homogenized, before it is worked, at a temperature between the initial melting temperature of the metastable eutectics and the temperature of the solidus of equilibrium.

20. A process according to claim 7 wherein the alloy is homogenized, before it is worked, at a temperature between the initial melting temperature of the metastable eutectics and the temperature of the solidus of equilibrium.

* * * * *